US005490230A

United States Patent [19]

Gerson et al.

[11] Patent Number: 5,490,230

[45] Date of Patent: Feb. 6, 1996

[54] DIGITAL SPEECH CODER HAVING OPTIMIZED SIGNAL ENERGY PARAMETERS

[76] Inventors: Ira A. Gerson, 1120 Nottingham La., Hoffman Estates, Ill. 60195; Mark A. Jasiuk, 6611 N. Hiawatha Ave., Chicago, Ill. 60646

[21] Appl. No.: 361,474

[22] Filed: Dec. 22, 1994

Related U.S. Application Data

[63] Continuation of Ser. No. 888,463, May 20, 1992, abandoned, which is a continuation of Ser. No. 422,927, Oct. 17, 1989, abandoned.

[51] Int. Cl.[6] ..... G10L 3/02

[52] U.S. Cl. ..... 395/2.34; 395/2.32

[58] Field of Search ..... 381/29–40; 395/2, 395/2.16, 2.25–2.32, 2.33, 2.34

[56] References Cited

U.S. PATENT DOCUMENTS

| | | | |
|---|---|---|---|
| 4,817,157 | 3/1989 | Gerson | 381/40 |
| 4,868,867 | 9/1989 | Davidson et al. | 381/31 |
| 4,899,385 | 2/1990 | Ketchum et al. | 381/36 |
| 4,910,781 | 3/1990 | Ketchum et al. | 381/36 |
| 4,932,061 | 6/1990 | Kroon et al. | 381/30 |
| 4,933,957 | 6/1990 | Bottau et al. | 381/29 |
| 4,969,192 | 11/1990 | Chen et al. | 381/31 |

OTHER PUBLICATIONS

Schroeder et al., "Code–Excited Linear Prediction (CELP): High Quality Speech at Very Low Bit Rates", IEEE ICASSP85, Mar. 26–29, 1985, Tampa, Fla., pp. 937–940.

"A Class of Analysis–by–Synthesis Predictive Coders For High Quality Speech Coding At Rates Between 4.8 and 16 kbits/s" by Peter Kroon and Ed Deprettere, Feb., 1988 issue of IEEE Journal On Selected Areas in Communications, pp. 353–363.

"Quantization Procedures for the Excitation in CELP Coders" by Peter Kroon and Bishnu Atal published in Apr. of 1987 by IEEE, pp. 1649–1652.

"High–Quality 4800 BPS Speech Coding for Real–Time Applications" by Daniel Lin published, 3 pages.

*Primary Examiner*—David D. Knepper

*Attorney, Agent, or Firm*—Christopher P. Moreno

[57] ABSTRACT

A speech coder and decoder methodology wherein pitch excitation and codebook excitation source energies are represented by parameters that are readily transmissible with minimal transmission capacity requirements. The parameters are the long term energy value, a short term correction factor which is applied to the long term energy value to match the short term energy, and proportionality factor(s) that specify the relative energy contribution of the excitation sources to the short term energy value.

9 Claims, 3 Drawing Sheets

600

| VECTOR CODE (601) | $\alpha$ (602) | $\beta$ (603) | $\pi$ (604) |
|---|---|---|---|
| 0000000 | 0.20 | 0.30 | 0.30 |
| 0000001 | 0.20 | 0.35 | 0.25 |
| 0000010 | 0.20 | 0.40 | 0.20 |
| 0000011 | 0.20 | 0.45 | 0.15 |
| ⋮ | | | |
| 1111100 | 0.30 | 0.30 | 0.30 |
| 1111101 | 0.30 | 0.35 | 0.25 |
| 1111110 | 0.30 | 0.40 | 0.20 |
| 1111111 | 0.30 | 0.45 | 0.15 |

DIGITAL SPEECH CODER HAVING OPTIMIZED SIGNAL ENERGY PARAMETERS

This is a continuation of application Ser. No. 07,888,463, filed May 20, 1992 and now abandoned which is a continuation of application Ser. No. 07/422,927, filed Oct. 17, 1989 and now abandoned.

TECHNICAL FIELD

This invention relates generally to speech coders, and more particularly to digital speech coders that use gain modifiable speech representation components.

BACKGROUND OF THE INVENTION

Speech coders are known in the art. Some speech coders convert analog voice samples into digitized representations, and subsequently represent the spectral speech information through use of linear predictive coding. Other speech coders improve upon ordinary linear predictive coding techniques by providing an excitation signal that is related to the original voice signal.

U.S. Pat. No. 4,817,157 describes a digital speech coder having an improved vector excitation source wherein a codebook of codebook excitation vectors is accessed to select an codebook excitation signal that best fits the available information, and is used to provide a recovered speech signal that closely represents the original. In such a system, pitch excitation information and codebook excitation information are developed and combined to provide a composite signal that is then used to develop the recovered speech information. Prior to combination of these signals, a gain factor is applied to each, to cause the amount of energy associated with each signal to be representational of the amount of energy associated with the original voice components represented by these constituent parts.

The speech coder determines the appropriate gain factors at the time of determining the appropriate pitch excitation and codebook excitation information, and coded information regarding all of these elements is then provided to the decoder to allow reconstruction of the original speech information. In general, prior art speech coders have provided this gain factor information to the decoder in discrete form. This has been accomplished either by transmitting the information in separate identifiable packets, or in other form (such as by vector quantization) where, though combined for purposes of transmission, are still effectively independent from one another.

Prior art speech coding techniques leave considerable room for improvement. The gain factor transmission methodology referred to above may require a considerable amount of transmission medium capacity to accomodate error protection (otherwise, errors that occur during transmission will corrupt the gain information, and this can result in extremely annoying incorrect speech reproduction results).

Accordingly, a need exists for a method of speech coding that reduces demands on the transmission medium, while simultaneously providing increased protection for gain factor information.

SUMMARY OF THE INVENTION

This need and others is substantially met through provision of the speech coding methodology disclosed herein. This speech coding methodology results in the production of gain information, including a first gain value that relates to gain for a first component representative of a speech sample, and a second gain value that relates to gain for a second component of that speech sample. Pursuant to this method, these gain values are processed to provide a first parameter that relates to an overall energy value for the sample, and a second parameter that is based, at least in part, on the relative contribution of at least one of the first and second gain values to the overall energy value for the sample. Information regarding the first and second parameters is then transmitted to a decoder.

In one embodiment of the invention, the gain information can include at least a third gain value that relates to gain for a third component of the sample. The processing of the gain values will then produce a third parameter that is based, at least in part, on the relative contribution of a different one of the first, second, and third gain values to the overall energy value.

In one embodiment of the invention, the first and second parameters (and the third, if available) are vector quantized to provide a code. This code then comprises the information that is transmitted to the decoder.

In another aspect of the invention, the gain information developed by the coder includes a first value that relates to a long term energy value for the speech signal (for example, an energy value that is pertinent to a plurality of samples or to a single predetermined frame of speech information), and a second value that relates to a short term energy value for the signal (for example, a single sample or a subframe that comprises a part of the predetermined frame), which second value comprises a correction factor that can be applied to the first value to adjust the first value for use with a particular sample or subframe. The first value is transmitted from the coder to the decoder at a first rate, and the second values are transmitted at a second rate, wherein the second rate is more frequent than the first rate. So configured, the more important information (the long term energy value) is transmitted less frequently, and hence may be transmitted in a relatively highly protected form without undue impact on the transmission medium capacity. The less important information (the short term energy values) are transmitted more frequently, but since they are less important to reconstruction of the signal, less protection is required and hence impact on transmission medium capacity is again minimized.

In another embodiment of the invention, the speech coder/decoder platform is located in a radio.

BEST MODE FOR CARRYING OUT THE INVENTION

U.S. Pat. No. 4,817,157, entitled "Digital Speech Coder Having Improved Vector Excitation Source," as issued to Ira Gerson on Mar. 28, 1989 is incorporated herein by this reference. This reference describes in significant detail a digital speech coder that makes use of a vector excitation source that includes a codebook of codebook excitation code vectors.

Figure 1:
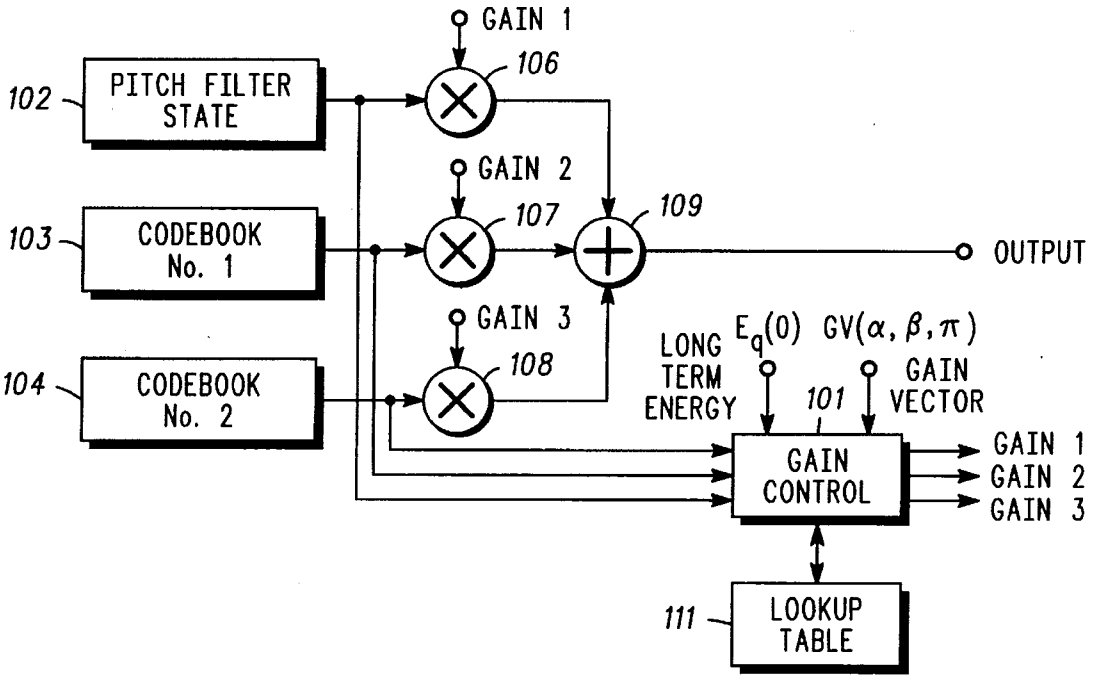
FIG. 1 comprises a block diagrammatic depiction of an excitation source configured in accordance with the invention.

As detailed in the above noted reference, this invention can be embodied in a speech coder (or decoder) that makes use of an appropriate digital signal processor such as a Motorola DSP56000 family device. The computational functions of such a DSP embodiment are represented in FIG. 1 as a block diagram equivalent circuit.

A pitch excitation filter state (102) provides a pitch excitation signal that comprises an intermediate pitch excitation vector. A multiplier (106) receives this pitch excitation vector and applies a GAIN 1 scale factor. When properly implemented, the resultant scaled pitch excitation vector will have an energy that corresponds to the energy of the pitch information in the original speech information. If improperly implemented, of course, the energy of the pitch information will differ from the original sample; significant energy differences can lead to substantial distortion of the resultant reproduced speech sample.

A first codebook (103) includes a set of basis vectors that can be linearly combined to form a plurality of resultant excitation signals. The coder functions generally to select whichever of these codebook excitation sources best represents the corresponding component of the original speech information. The decoder, of course, utilizes whichever of the codebook excitation sources is identified by the coder to reconstruct the speech signal. (The pitch excitation signal and codebook selections are, of course, identified in corresponding component definitions for the sample being processed.) As with the pitch excitation information, a multiplier (107) receives the codebook excitation information and applies GAIN 2 as a scaling factor. Application of GAIN 2 functions to properly scale the energy of the codebook excitation signal to cause correspondence with the actual energy in the original signal that accords with this speech information component.

If desired, a particular application of this approach may utilize additional codebooks (104) that contain additional excitation signals. The output of these additional codebooks will also be scaled by an appropriate multiplier (108) using appropriate scaling factors (such as GAIN 3) to achieve the same purposes as those outlined above.

Figure 4:
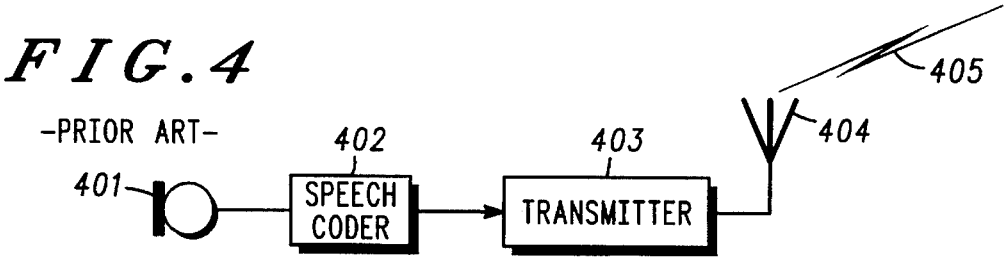
FIG. 4 is a block diagram of a radio transmitter employing a speech coder.

Once provided and properly scaled, the pitch excitation and codebook excitation information can be summed (109) and provided to an LPC filter to yield a resultant speech signal. In a coder, this resultant signal will be compared with the original signal, and the process repeated with other codebook contents, to identify the excitation source that provides a resultant signal that most closely corresponds to the original signal. The pitch and codebook information will then be coded and transmitted to the decoder by a transmission medium of choice. FIG. 4 illustrates this transmission process in block diagram form. Speech samples are provided to a speech coder (402), such as the one discussed above, through an associated microphone (401). The output of the speech coder (403) is then coupled to a radio transmitter (403), well-known in the art, where the speech coder output signals are used to generate a modulated RF carrier (405) that can be transmitted through a suitable antenna structure (404). In a decoder, this resultant signal will be further processed to render the digitized information into audible form, thereby completing reconstruction of the voice signal.

Prior to describing this embodiment of the invention from the standpoint of a coder, it will be helpful to first explain the decoding process.

A gain control (101) function provides the GAIN 1 and GAIN 2 information (and, in an appropriate application, the GAIN 3 information as well). This gain information is provided as a function of the actual energy of the recovered pitch excitation and codebook excitation signals, a long term energy value as provided by the coder, and a gain vector provided by the coder that supplies a short term correction value for the long term energy value.

The energy of the pitch excitation and codebook excitation signals that are output from the pitch excitation filter state (102) and the codebook(s) (103 and 104) (i.e., the pre-components) can be readily determined by the gain control (101). In general, the energy of these signals, both as divided between the two (or three) signals and as viewed in the aggregate, will not properly reflect the energies in the original signal. This energy information is therefore necessary to know in order to determine the amount of energy correction that will be required. This energy correction is accomplished by adjusting GAIN 1 and GAIN 2 (and GAIN 3 if applicable). This correction occurs on a subframe by subframe basis.

This process of calculating the energy of the pitch excitation and codebook excitation signals in the decoder provides an important advantage. In particular, previous transmission errors that would result in improper energy of the pitch excitation signal will be compensated for by explicitly calculating the energy of the pitch excitation in the decoder.

For purposes of this description, it will be presumed that an original speech sample (or at least a portion thereof) is digitized, and that the resultant digital information is divided as necessary into frames and subframes of data, all in accordance with well understood prior art technique. In this description, it will also be presumed that each frame is comprised of four subframes. So configured, the long term energy value comprises an energy value that is generally representative of a single frame, and the short term correction value constitutes a correction factor that corresponds to a single subframe. The approximate residual energy (EE) pertaining to a specific subframe can be generally determined by:

$$EE = \frac{E_q(0)}{(\text{FILTER POWER GAIN})\,(N_\text{SUBS})}$$

where:

$E_q(0)$=quantized long term signal energy for total frame, and FILTER POWER GAIN may be computed from LPC filter information that corresponds to an energy increase imposed by the filter, as well understood in the art and N_SUBS is the number of subframes per frame.

GAIN 1 can then be calculated as:

$$A = \sqrt{\frac{EE\alpha\beta}{E_x(0)}}$$

where:

$\alpha$=a first vector parameter;

$\beta$=a second vector parameter; and $E_x(0)$=unweighted pitch energy information.

Details regarding $\alpha$ and $\beta$ will be provided below when describing the coding function. $E_x(0)$ constitutes the energy of the signal that is output by the pitch excitation filter state (102). $E_x(0)$ is therefore the energy for the pitch excitation vector prior to being scaled by the GAIN 1 value as applied via the multiplier (106). $E_x(0)$ in the denominator of A normalizes the energy in the unweighted pitch excitation vector to unity, while the numerator of A imposes the desired energy onto the pitch excitation vector. In the numerator, the term EE (the estimate of the subframe residual energy based on the long term signal energy) is scaled by $\alpha$ to match the short term energy in the excitation signal, with $\beta$ specifying the fraction of the energy in the combined excitation signal due to the pitch excitation vector. Finally, taking the square root of the expression yields the gain.

In a similar manner, GAIN 2 can be calculated as:

$$B=\sqrt{\frac{EE\alpha(1-\beta)}{E_x(1)}}$$

$\alpha$ and $\beta$ are as described above. $E_x(1)$ comprises the unweighted codebook excitation information that corresponds to the energy as actually output from the first codebook (111).

With GAIN 1 and GAIN 2 calculated as determined above, the pitch excitation and codebook excitation information will be properly scaled, both with respect to their values visa vis one another, and as a composite result provided at the output of the summation function (109), thereby providing appropriate recovered components of the signal. In a decoder that makes use of one or more additional excitation codebooks (104), the additional scale factors (for example, GAIN 3), can be determined in similar manner.

A coder embodiment of the invention will now be described.

As referred to earlier, a quantized signal energy value $E_q(0)$ can be calculated for a complete frame of digitized speech samples. This value is transmitted from the coder to the decoder from time to time as appropriate to provide the decoder with this information. This information does not need to be transmitted with each subframe's information, however. Therefore, since this long term information can be sent less frequently, this information can be relatively well protected through error coding and the like. Although this requires more transmission capacity, the overall impact on capacity is relatively benign due to the relatively infrequent transmission of this information.

As also referred to earlier, the long term energy information as pertains to a frame must be modified for each particular subframe to better represent the energy in that subframe. This modification is made as a function, in part, of the short term correction parameter $\alpha$.

The coder develops these parameters $\alpha$ and $\beta$, in turn, as a function of the energy content of the pitch excitation and codebook excitation information signals as developed in the coder. In particular, $\alpha$ comprises a scale factor by which the long term energy information should be scaled to yield the sum of the pitch excitation information energy, codebook 1 excitation, and the codebook 2 excitation in a particular subframe. $\beta$, however, comprises a ratio; in this embodiment, $\beta$ comprises the ratio of the pitch excitation information energy for the subframe in question to the sum of the energies attributable to the pitch excitation information, codebook 1, and codebook 2 excitations. In a similar manner, and presuming again the presence of a second codebook, a third parameter $\pi$ can represent the ratio of the energy of the first codebook energy to the sum of the energies attributable to the pitch excitation information, codebook 1, and codebook 2 excitations.

So processed, the first parameter $\alpha$ relates to an overall energy value for the signal sample, and the second (and third, if used) parameter $\beta$ relates, at least in part, to the relative contribution of one of the excitation signals to the overall energy value. Therefore, to some extent, the parameters $\alpha$, $\beta$, and $\pi$ are interrelated to one another. This interrelationship contributes to the improved performance and encoding efficiency of this coding and decoding method.

Figures 5, 6:
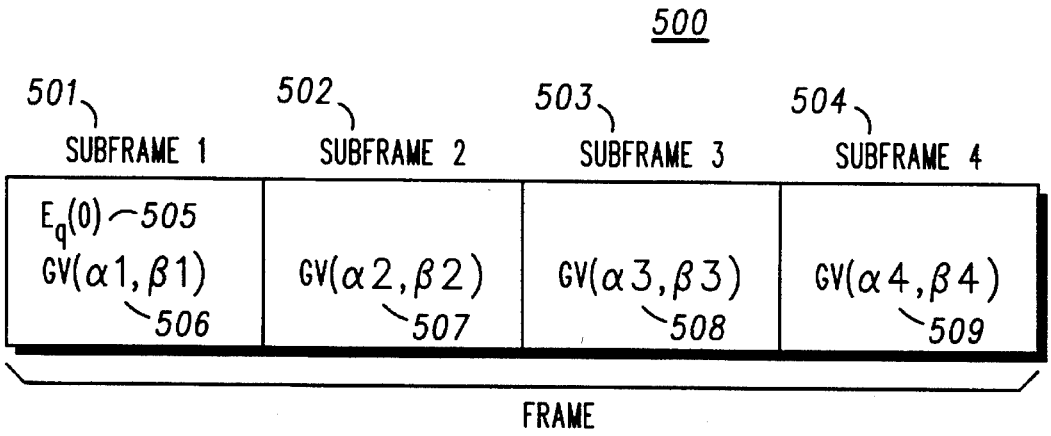
FIG. 5 illustrates frame and subframe organization of digitized speech samples.
FIG. 6 is a chart showing portions of a vector quantized signal energy parameter data base.

FIG. 5 illustrates how a complete frame of digitized speech samples, generally depicted by the numeral 500, is divided into subframes. As mentioned previously, each frame is divided into four subframes (501–504). The quantized signal energy value $E_q(0)$ (505), calculated for each complete frame of digitized speech samples, is transmitted once per frame. The $\alpha$ and $\beta$ parameters, indicated in the figure as part of a gain vector (GV) (506–509) are transmitted for every subframe.

In this embodiment, the coder does not actually transmit the three parameters $\alpha$, $\beta$, and $\pi$ to the decoder. Instead, these parameters are vector quantized, and a representative code that identifies the result is transmitted to the decoder. Portions of a vector quantized signal energy parameter data base, generally depicted by the numeral 600, are shown in FIG. 6. The data base comprises a set of seven-bit representative codes or vectors (601), and a set of associated signal energy parameters. There are 128 possible vector codes (601) in this example, with each vector code having an associated $\alpha$, $\beta$, and $\pi$ parameter (602–604). The decimal numbers shown in the figure are for example purposes only, and would have to be selected in practice to compliment all of the particulars of a specific application. Since the coder will not likely be able to transmit a code that represents a vector that exactly emulates the original vector, some error will likely be introduced into the representation at this point. To minimize the impact of such an error, the coder calculates an ERROR value for each and every vector code available to it, and selects the vector code that yields the minimum error. For each vector code (which yields a related value for $\alpha$ and $\beta$, presuming here for the sake of example a single codebook coder), this ERROR value can be calculated as follows:

$$\text{ERROR}=E_v-\eta\sqrt{\alpha\beta}-i\sqrt{\alpha(1-\beta)}+\phi\alpha\sqrt{\beta(1-\beta)}+\kappa\alpha\beta+\lambda\alpha(1-\beta)$$

where:

$$\eta=2E_{pc}(0)\sqrt{\frac{EE}{E_x(0)}}$$

$$i=2E_{pc}(1)\sqrt{\frac{EE}{E_x(1)}}$$

$$\phi=\frac{2E_{cc}(0,1)EE}{\sqrt{E_x(0)E_x(1)}}$$

$$\kappa=\frac{EE\,E_{cc}(0,0)}{E_x(0)}$$

$$\lambda=\frac{EE\,E_{cc}(1,1)}{E_x(1)}$$

In the above equations, $E_v$ represents the subframe energy in an ideal signal. Therefore, the closer the selected representative parameters represent the original parameters, the smaller the error. $E_{pc}(0)$ represents the correlation between the ideal signal and the weighted pitch information excitation. $E_{pc}(1)$ represents the correlation between the ideal signal and the weighted codebook excitation. $E_{cc}(0,1)$ represents the correlation between the weighted pitch information excitation and the weighted codebook excitation. And finally, $E_{cc}(0,0)$ represents the energy in the weighted pitch excitation, and $E_{cc}(1,1)$ represents the energy in the weighted codebook excitation. (Weighted excitations are the excitation signals after processing by a perceptual weighting filter as known in the art.)

When the vector code that yields the smallest ERROR value has been identified, that vector code is then transmitted to the decoder. When received, the decoder uses the vector code to access a vector code database and thereby recover values for the α, β, and π (if present) parameters, which parameters are then used as explained above to calculate GAIN 1, GAIN 2, and GAIN 3 (if used).

By use of this methodology, a number of important benefits are obtained. For example, the long term energy value, which may be relatively heavily protected during transmission, will ensure that the recovered voice information will be generally properly reconstructed from the standpoint of energy information, even if the short term correction factor information is lost or corrupted. The computation of, and compensation for, the pitch energy at the decoder significantly reduces error propagation of the pitch excitation.

Further, the interrelationship of the original gain information as represented in the α, β, and π parameters allows for a greater condensation of information, and concurrently further minimizes transmission capacity requirements to support transmittal of this information. As a result, this methodology yields improved reconstructed speech results with a concurrent reduced transmission capacity requirement.

Figure 3:
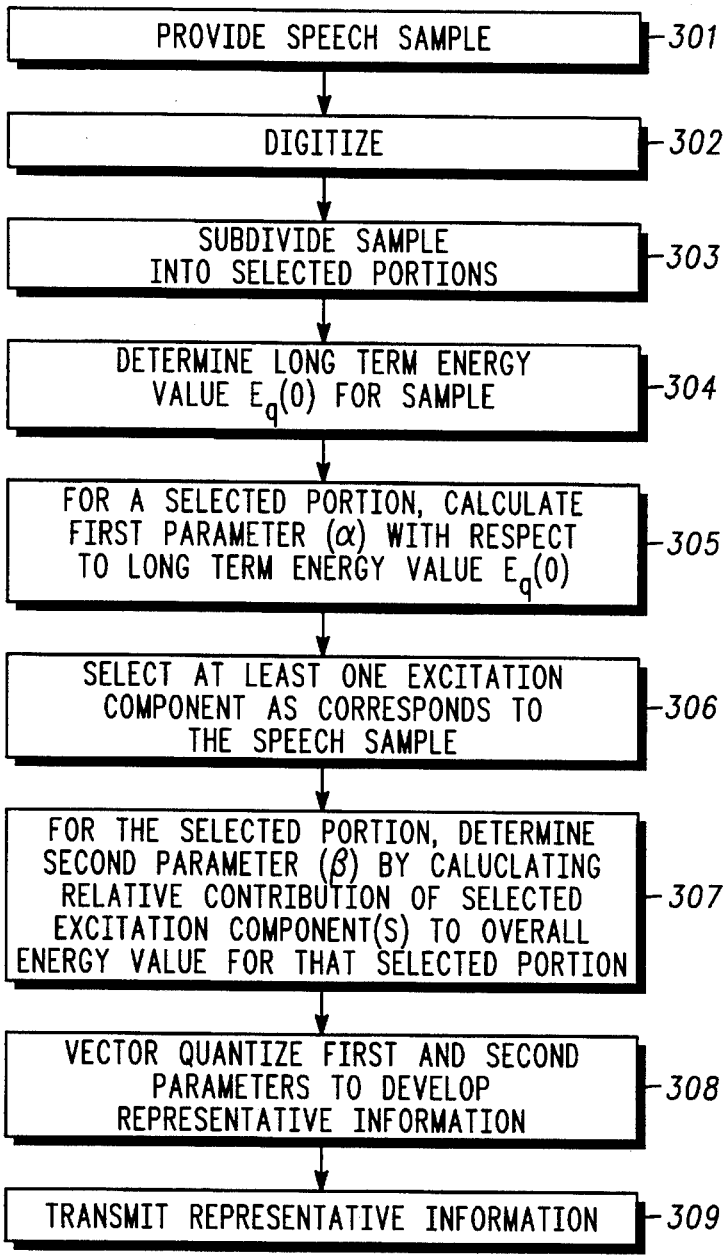
FIG. 3 is a flowchart depicting a speech coding methodology in accordance with the present invention.

The flowchart of FIG. 3 provides a concise representation of method steps used to code and transmit a succession of speech samples in the manner taught by the present invention. As discussed previously, a speech sample is provided to a speech coder (block 301) and digitized (302). In the next step (303), the sample is subdivided into selected portions or subframes.

In the subsequent operation (304), a long term energy value $E_q(0)$ is determined for the sample. Then (305), for a selected portion of the sample, a first parameter α is calculated with respect to the long term energy value. As suggested in the discussion above, this first parameter α may be a scale factor that relates the long term energy value to the overall energy in a particular subframe.

In the next step (306), at least one excitation component as corresponds to the speech sample is selected. This excitation component may be the pitch excitation information energy for a particular subframe. After this component is selected, the next operation (307) determines a second parameter β by calculating the relative contribution of this selected excitation component (or components) to the overall energy value for that subframe.

The subsequent operation (308) vector quantizes the first and second parameters in order to develop representative information. Vector quantizing, of course, yields a representative code that identifies the information. This results in significant information compression when compared to the first and second parameters themselves. Finally (309), the representative information is transmitted.

Figure 2:
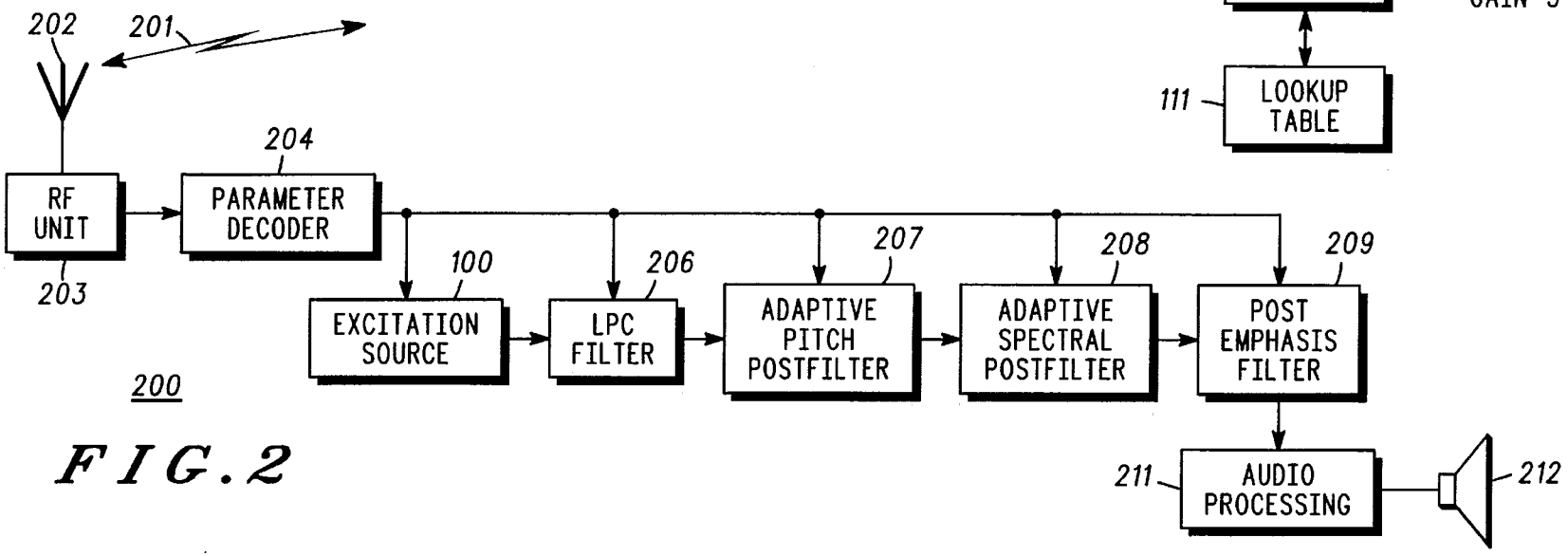
FIG. 2 comprises a block diagrammatic depiction of a radio configured in accordance with the invention.

In FIG. 2, a radio embodying the invention includes an antenna (202) for receiving a speech coded signal (201). An RF unit (203) processes the received signal to recover the speech coded information. This information is provided to a parameter decoder (204) that develops control parameters for various subsequent processes. An excitation source (100) as described above utilizes the parameters provided to it to create an excitation signal. This resultant excitation signal from the excitation source (100) is provided to an LPC filter (206) which yields a synthesized speech signal in accordance with the coded information. The synthesized speech signal is then pitch postfiltered (207), and spectrally postfiltered (208) to enhance the quality of the reconstructed speech. If desired, a post emphasis filter (209) can also be included to further enhance the resultant speech signal. The speech signal is then processed in an audio processing unit (211) and rendered audible by an audio transducer (212).

We claim:

1. A method for transmitting information that relates to gain information, which gain information is to be applied to excitation information that corresponds to a speech sample, wherein the gain information includes:

a first gain value to be applied to a first excitation component, which first excitation component represents a first voice component of the speech sample, which first voice component has a first energy value;

at least a second gain value to be applied to a second excitation component, which second excitation component represents a second voice component of the speech sample, which second voice component has a second energy value;

the method comprising the steps of:

A) providing a speech sample;

B) digitizing the speech sample to provide a frame of information comprising at least one subframe;

C) determining total energy of the frame of information to provide a long term energy value;

D) determining an overall energy value for a subframe of the at least one subframe;

E) providing a first parameter, wherein the first parameter is proportional to the overall energy value and inversely proportional to the long term energy value;

F) providing a second parameter, wherein the second parameter is proportional to the first energy value and inversely proportional to the overall energy value; and G) transmitting information related to the long term energy value and the first and second parameters.

2. The method of claim 1 wherein:

the gain information includes at least a third gain value that relates to gain to be applied to a third excitation component, which third excitation component represents a third voice component of the speech sample, which third voice component has a third energy value;

the method includes the additional step, before step G), of:

F1) providing a third parameter, wherein the third parameter is proportional to the second energy value and inversely proportional to the overall energy value;

the step of transmitting information includes transmission of information relating to the third parameter.

3. The method of claim 1 further including the step of vector quantizing at least the first parameter and second parameter information to provide a code.

4. The method of claim 3 wherein the step of transmitting includes transmitting the code.

5. A method for transmitting information that relates to gain information for a speech sample, comprising the sleds of:

A) providing a speech sample;

B) digitizing the speech sample to provide a frame of information comprising at least one subframe;

C) determining a first value comprising a long term energy value for the frame of information;

D) determining at least a second value, wherein the second value is proportional to an overall energy value and inversely proportional to the long term energy value, wherein the overall energy value is determined for a subframe of the at least one subframe;

E) transmitting, at a first rate, information relating to the first value; and

F) transmitting, at a second rate more frequent than the first rate, information relating to the second value.

6. A method for recovering information that relates to gain information for excitation components of a speech sample, wherein the speech sample is digitized to provide a frame of information comprising at least one subframe, the method comprising the steps of:

A) receiving at least one parameter comprising a log term energy value for the frame of information;

B) receiving excitation component definition information for at least one excitation component;

C) processing the excitation component definition information to provide a pre-component, which pre-component has an energy value;

D) determining a gain value that is proportional to the long term energy value and inversely proportional to the energy value; and E) applying the gain value to the pre-component, to provide a recovered excitation component of the speech sample.

7. A method for recovering information that relates to gain information for excitation components of a speech sample, wherein the speech sample is digitized to provide a frame of information comprising at least one subframe, the method comprising the steps of:

A) receiving a radio signal;

B) demodulating the radio signal to provide a recovered signal;

C) extracting from the recovered signal at least one parameter comprising a long term energy value for the frame of information;

D) extracting from the recovered signal excitation component definition information for at least one excitation component;

E) processing the excitation component definition information to provide a pre-component, which pre-component has an energy value;

F) determining a gain value that is proportional to the long term energy value and inversely proportional to the energy value; and G) applying the gain value to the pre-component to provide a recovered component of the speech sample.

8. A radio that receives speech coded information and that synthesizes speech in response thereto, comprising:

A) RF means for receiving and demodulating a radio signal that includes speech coded information;

B) excitation source means operably coupled to the RF means for receiving the speech coded information; and for:

1) extracting from the speech coded information at least one parameter comprising a long term energy value for information, wherein a speech sample is digitized to provide the frame of information comprising at last one subframe;

2) extracting from the speech coded information excitation component definition information for at least one excitation component;

3) processing the excitation component definition information to provide a pre-component, which pre-component has an energy value;

4) determining a gain value that is proportional to the long term energy value and inversely proportional to the energy value;

5) applying the gain value to the pre-component to provide a recovered component of the speech sample;

6) providing an excitation signal using the recovered component; and

C) LPC filter means for receiving the excitation signal and for providing a synthesized speech signal in response thereto.

9. The radio of claim 8, and further comprising:

A) audio processing means operably coupled to the LPC filter means for rendering the synthesized speech signal audible.

* * * * *

UNITED STATES PATENT AND TRADEMARK OFFICE

CERTIFICATE OF CORRECTION

PATENT NO. : 5,490,230

DATED : February 6, 1996

INVENTOR(S) : Ira A. Gerson; Mark A. Jasiuk

It is certified that error appears in the above-identified patent and that said Letters Patent is hereby corrected as shown below:

Column 8, line 57, the word "sleds" should be --steps--.

Column 9, line 12, the word "log" should be --long--.

Column 10, line 15, please insert --a frame of-- after "for".

Column 10, line 23, please delete "an" and insert --a pre-component-- after "has".

Column 10, line 26, please insert --pre-component-- after "the".

Signed and Sealed this

Third Day of September, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,490,230
DATED : February 6, 1996
INVENTOR(S) : Ira A. Gerson and Mark A. Jasiuk It is certified that error appears in the above-indentified patent and that said Letters Patent is hereby corrected as shown below:

Column 10, line 17, the word "last" should be --least--.

Signed and Sealed this

First Day of October, 1996

Bruce Lehman

*Attest:*

BRUCE LEHMAN

*Attesting Officer*

*Commissioner of Patents and Trademarks*